US010914250B2

(12) United States Patent
Kim et al.

(10) Patent No.: US 10,914,250 B2
(45) Date of Patent: Feb. 9, 2021

(54) METHOD OF CONTROLLING PURGE OF FUEL EVAPORATION GAS

(71) Applicants: Hyundai Motor Company, Seoul (KR); Kia Motors Corporation, Seoul (KR)

(72) Inventors: Wan Ho Kim, Seongnam-si (KR); Hee Sup Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/684,002

(22) Filed: Nov. 14, 2019

(65) Prior Publication Data

US 2020/0182169 A1 Jun. 11, 2020

(30) Foreign Application Priority Data

Dec. 7, 2018 (KR) ..... 10-2018-0157126

(51) Int. Cl.
*F02D 41/00* (2006.01)
*F02M 25/08* (2006.01)

(52) U.S. Cl.
CPC ..... *F02D 41/004* (2013.01); *F02D 41/0042* (2013.01); *F02D 41/0045* (2013.01); *F02M 25/0809* (2013.01)

(58) Field of Classification Search
CPC ..... F02D 41/0032; F02D 41/0035; F02D 41/004; F02D 41/0042; F02D 41/0045; F02D 41/045; F02D 41/12; F02D 41/123; F02M 25/0809
See application file for complete search history.

(56) References Cited

U.S. PATENT DOCUMENTS 4,630,581 A * 12/1986 Shibata ..... F02D 41/0032 123/325
5,048,492 A * 9/1991 Davenport ..... F02D 41/0032 123/520
5,048,493 A * 9/1991 Orzel ..... F02D 41/0045 123/520
5,535,719 A * 7/1996 Morikawa ..... F02D 41/0045 123/339.17
5,682,863 A * 11/1997 Kadooka ..... F02D 41/004 123/520
5,735,255 A * 4/1998 Farmer ..... F02D 41/0042 123/520

(Continued)

FOREIGN PATENT DOCUMENTS

JP 05018295 A * 1/1993
JP 05248316 A * 9/1993

(Continued)

*Primary Examiner* — John M Zaleskas
(74) *Attorney, Agent, or Firm* — Slater Matsil, LLP

(57) ABSTRACT

A purge control method of the present disclosure includes determining whether or not a vehicle quickly decelerates in a driving situation in which a large amount of fuel evaporation gas is discharged, decreasing purge duty for operating a purge control solenoid valve when the controller determines that the vehicle is in a state of quick deceleration, and decreasing a purge flow of the fuel evaporation gas by controlling operation of the purge control solenoid valve by the purge duty.

15 Claims, 2 Drawing Sheets

(56) References Cited

U.S. PATENT DOCUMENTS 5,765,541 A * 6/1998 Farmer ..... F02D 41/0042 123/520
5,862,795 A * 1/1999 Osanai ..... F02D 41/004 123/520
5,988,150 A * 11/1999 Osanai ..... F02D 41/0042 123/520
6,343,467 B1 * 2/2002 Muto ..... F02D 41/0042 123/518
6,595,190 B1 * 7/2003 Sealy ..... F02D 41/0032 123/518
6,651,640 B1 * 11/2003 Sealy ..... F02D 41/0045 123/520
7,171,960 B1 * 2/2007 Hagari ..... F02D 41/0042 123/472
2004/0007215 A1 * 1/2004 Kawano ..... F02M 25/08 123/520
2004/0045538 A1 * 3/2004 Tagami ..... F02M 25/08 123/520
2004/0237946 A1 * 12/2004 Murakami ..... F02M 25/08 123/520
2005/0124460 A1 * 6/2005 Iriyama ..... F02D 41/022 477/107
2005/0274368 A1 * 12/2005 Itakura ..... F02D 41/0042 123/698
2006/0272400 A1 * 12/2006 Wakahara ..... F02M 25/0809 73/114.37
2007/0186915 A1 * 8/2007 Annoura ..... F02D 41/0042 123/698
2007/0277789 A1 * 12/2007 Ishikawa ..... F02D 41/0045 123/520
2008/0312808 A1 * 12/2008 Mino ..... F02D 41/0045 701/104
2010/0235072 A1 * 9/2010 Okazaki ..... F02D 41/0042 701/106
2016/0230681 A1 * 8/2016 Tanaka ..... F02D 41/045
2016/0230707 A1 * 8/2016 Tanaka ..... F01N 3/20
2016/0237926 A1 * 8/2016 Tanaka ..... F02D 41/1454
2016/0273506 A1 * 9/2016 Misawa ..... F02D 41/0032
2016/0305352 A1 * 10/2016 Pursifull ..... F02M 35/104
2018/0171896 A1 * 6/2018 Iihoshi ..... F02M 25/08
2018/0195449 A1 * 7/2018 Mano ..... F02D 41/3094
2020/0173382 A1 * 6/2020 Sugiura ..... F02D 41/04

FOREIGN PATENT DOCUMENTS

JP 07180621 A * 7/1995
JP 2004076673 A * 3/2004
JP 2007198210 A * 8/2007
KR 20020074724 A 10/2002

* cited by examiner

METHOD OF CONTROLLING PURGE OF FUEL EVAPORATION GAS

CROSS-REFERENCE TO RELATED APPLICATIONS

This application claims priority to Korean Patent Application No. 10-2018-0157126, filed on Dec. 7, 2018, which application is hereby incorporated herein by reference.

TECHNICAL FIELD

The present disclosure relates generally to a method of controlling purge of fuel evaporation gas.

BACKGROUND

Generally, there is a problem that hydrocarbon gas (i.e., fuel evaporation gas) evaporated in a fuel tank causes environmental pollution when it is discharged to the atmosphere, and gives displeasure to the passenger because of fuel odor when it flows inside a vehicle.

In order to solve this problem, a method of collecting the fuel evaporation gas in a canister is used. In this method, the fuel evaporation gas collected in the canister flows into an engine surge tank through a purge control solenoid valve and is combusted.

Here, in order to consume the fuel evaporation gas collected in the canister while driving, purge duty is controlled to satisfy a target purge flow calculated from a controller (an electronic control unit, ECU). In addition, the target purge flow and the purge duty are determined by a flow map that is pre-measured based on general driving conditions of the vehicle.

In addition, it takes time for the fuel evaporation gas flowing from the purge control solenoid valve to move to the engine surge tank. Therefore, transport delay required to transport the fuel evaporation gas from the purge control solenoid valve to the engine surge tank is calculated for controlling an air-fuel ratio precisely, and an injection amount and timing of fuel is controlled in consideration of the calculated transport delay.

When the driving condition is normal or the purge flow is low, influence of the transport delay is relatively low. However, when the vehicle quickly decelerates while driving at a predetermined vehicle speed or more in a condition in which the large amount of fuel evaporation gas is discharged, such as in a hot place, a calculated value of the mapped transport delay is not precise and the air-fuel ratio often becomes excessively rich. Therefore, purge operation is frequently stopped, and the air-fuel ratio excessively flows, thereby causing start-off and shock, which is problematic.

The foregoing is intended merely to aid in the understanding of the background of the present disclosure, and is not intended to mean that the present disclosure falls within the purview of the related art that is already known to those skilled in the art.

SUMMARY

The present disclosure relates generally to a method of controlling purge of fuel evaporation gas. Particular embodiments relate to a method of controlling purge of fuel evaporation gas, which reduces purge flow so that an air-fuel ratio is precisely controlled in a driving condition in which a large amount of fuel evaporation gas is discharged.

Embodiments the present disclosure has been made keeping in mind the above problems occurring in the related art. Embodiments propose a method of controlling purge of fuel evaporation gas, which can precisely control an air-fuel ratio by reducing purge flow in a driving condition in which a large amount of fuel evaporation gas is discharged.

According to one aspect of the present disclosure, a method can be used for controlling purge of fuel evaporation gas. A controller determines whether or not a vehicle quickly decelerates in a driving situation in which a large amount of fuel evaporation gas is discharged. The controller decreases purge duty for operating a purge control solenoid valve when the controller determines that the vehicle is in a state of quick deceleration. The controller decreases a purge flow of the fuel evaporation gas by controlling operation of the purge control solenoid valve by the purge duty.

When purge concentration is higher than a predetermined value, an accelerator pressing amount is higher than a first reference value, and an intake air amount is higher than a predetermined amount, the vehicle may be in the driving situation in which the large amount of fuel evaporation gas is discharged.

When an accelerator pressing amount is less than a second reference value and a slope of the amount of pressing an accelerator is less than a reference value, the vehicle may be determined to be in a quick deceleration situation.

Decreasing the purge duty may include accumulating a cylinder counter by counting the number of cylinder combustion when a quick deceleration condition of the vehicle is satisfied in the driving situation in which the large amount of fuel evaporation gas is discharged, calculating transport delay required to transport the fuel evaporation gas from the purge control solenoid valve to a combustion chamber by functions of engine revolutions per minute (RPM) and an intake air amount, determining a delay correction filter by functions of the engine RPM and the cylinder counter, correcting the transport delay by multiplying the transport delay by the delay correction filter, and arithmetically operating the purge duty by multiplying a value determined by functions of a target purge flow, a corrected new transport delay, and intake air pressure of an engine by a correction factor determined by atmospheric pressure and intake air temperature. The delay correction filter is higher than zero and is equal to or less than one ($0<\text{delay correction filter}\leq 1$).

The method may further include resetting the cylinder counter to zero when the accumulated cylinder counter is higher than a predetermined value; and setting the delay correction filter to one after the cylinder counter is reset to zero.

As described above, in the case of a driving condition in which the large amount of fuel evaporation gas is discharged, by decreasing a ratio of fuel due to the purge flow in total fuel by decreasing control of purge duty, the air-fuel ratio is prevented from being rich and combustion stability is improved, so that start-off and shock can be prevented, and the introduction of fuel odor into a vehicle due to an increase in the purge flow can be attenuated.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION OF ILLUSTRATIVE EMBODIMENTS

Hereinbelow, exemplary embodiments of the present disclosure will be described in detail with reference to the accompanying drawings.

Figure 1:
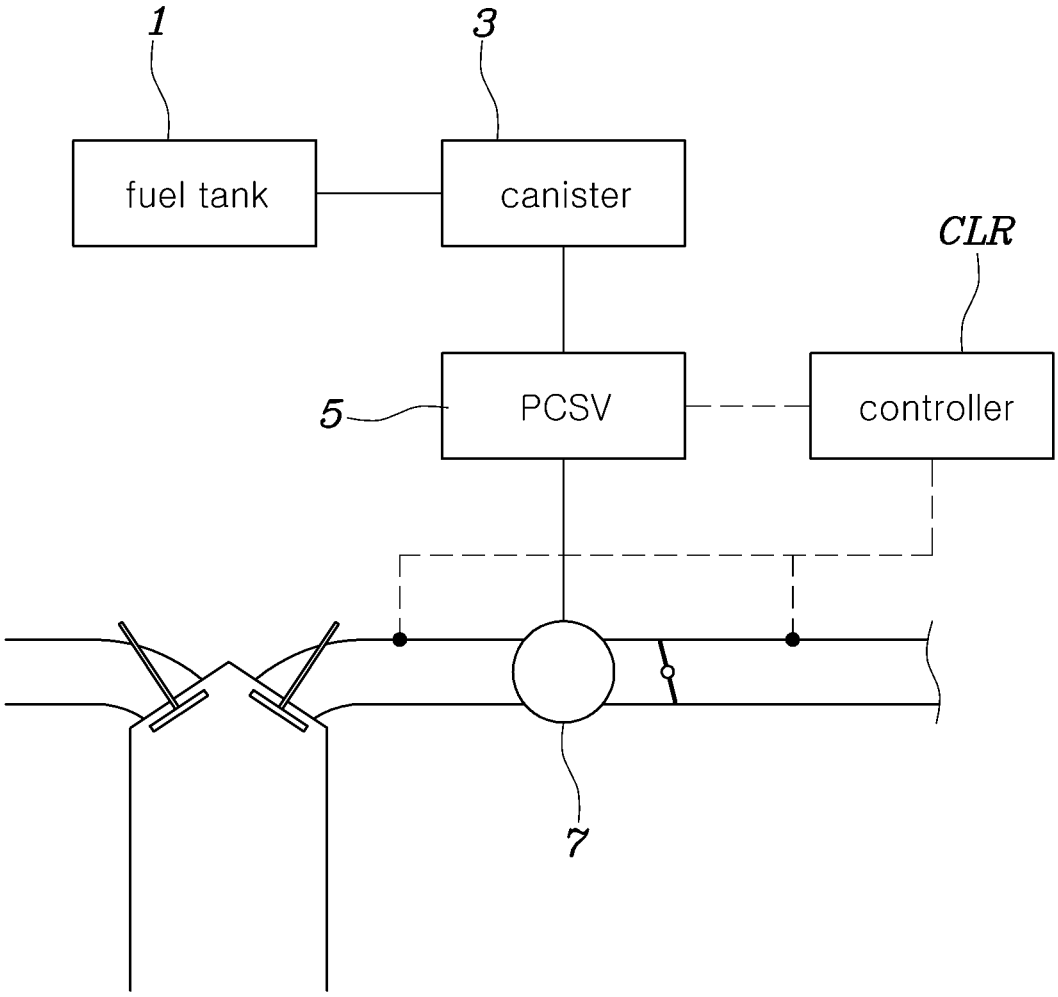
FIG. 1 is a schematic view showing a structure of a purge system that is applicable to the present disclosure.

FIG. 1 is a schematic view showing a structure of a purge system that is applicable to the present disclosure, which is provided with a canister 3 for collecting fuel evaporation gas generated from a fuel tank 1 and a purge control solenoid valve (PCSV) 5 provided between the canister 3 and an engine surge tank 7. Therefore, when an engine is in a state of negative pressure, the fuel evaporation gas collected in the canister 3 is desorbed from the canister 3 and flows in the engine by operation of the PCSV 5, and the fuel evaporation gas is combusted and purged.

In addition, an injection amount of fuel may be controlled in consideration of a ratio of fuel evaporation gas in a purge flow flowing through the PCSV 5. Particularly, the present disclosure is configured so that sensing values such as atmospheric pressure, engine intake air pressure, intake air temperature, engine revolutions per minute (RPM), and an intake air amount are input to a controller (CLR). On the basis of input signals of the sensing values, a target purge flow and a purge duty is calculated thereby controlling the purge flow.

Figure 2:
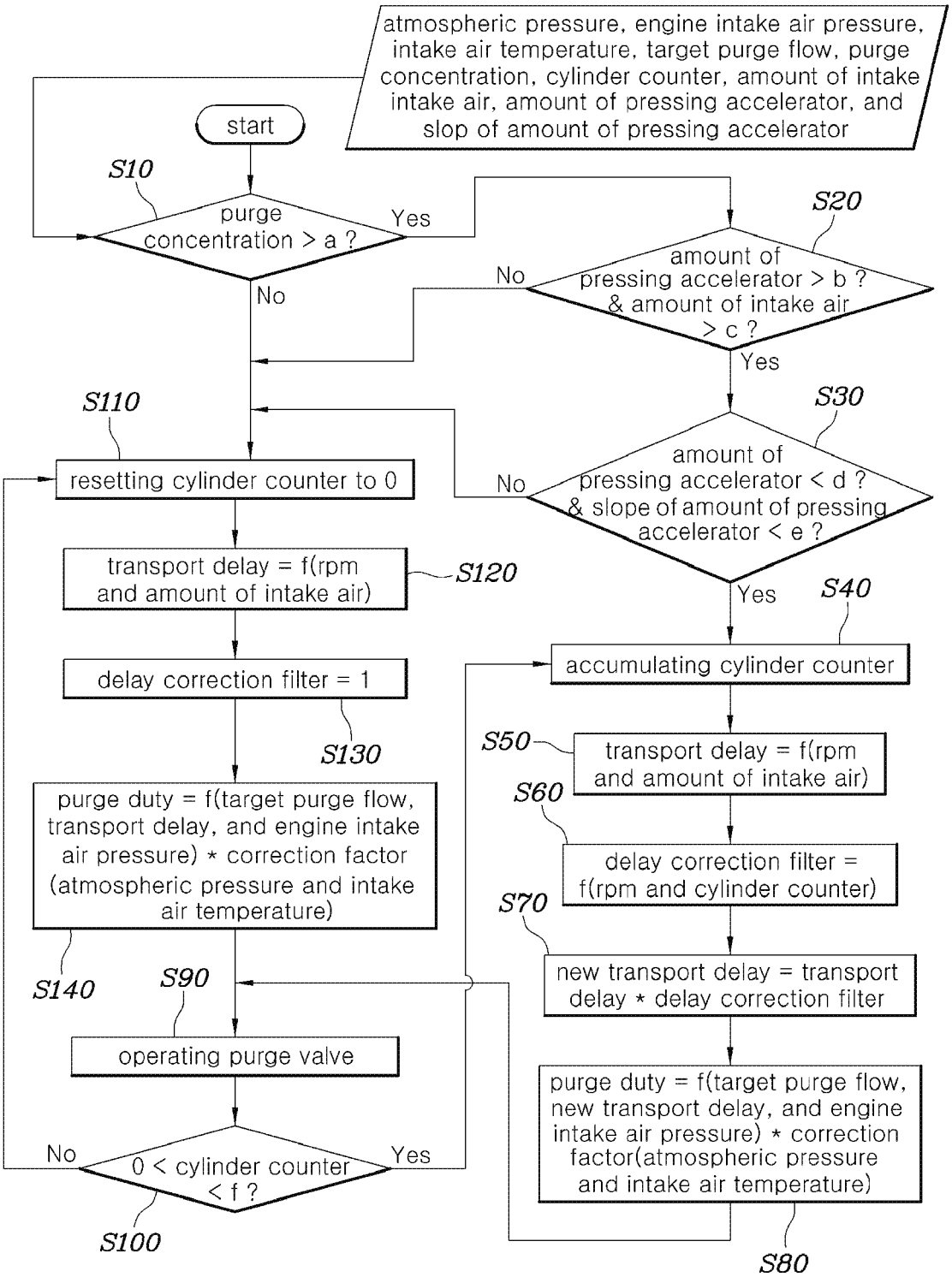
FIG. 2 is a flowchart showing a flow of purge control process according to the present disclosure.

Referring to FIG. 2 that is a flowchart showing a flow of purge control process according to the present disclosure, a purge control method of the present disclosure includes determining whether or not a vehicle quickly decelerates in a driving situation in which a large amount of fuel evaporation gas is discharged, by the CLR, decreasing purge duty for operating the PCSV 5 when the CLR determines that the vehicle is in a state of quick deceleration, and decreasing, by the CLR, a purge flow of the fuel evaporation gas by controlling operation of the PCSV 5 by purge duty.

Here, the driving situation in which the large amount of fuel evaporation gas is discharged may be a case of satisfying all conditions in which purge concentration is higher than a predetermined value, an accelerator pressing amount is higher than a first reference value, and an intake air amount is higher than a predetermined amount. The purge concentration may be obtained by calculating a ratio of the fuel evaporation gas in purge air supplied from the canister 3.

In addition, like as tip-out operation of an accelerator, when the accelerator pressing amount is less than a second reference value that is smaller than the first reference value and a slope of the accelerator pressing amount is less than a reference value, it may be determined that the vehicle is in a quick deceleration situation.

That is, when the purge concentration is higher than the predetermined value and engine load rapidly decreases while being operated at a specific value or higher, a dynamic purge condition is determined to be satisfied. When the dynamic purge condition is satisfied, by decreasing a fuel ratio due to the purge flow in total fuel through decrease control of the purge duty, an air-fuel ratio is prevented from being rich so that combustion stability may be improved.

In decreasing the purge duty, when a quick deceleration condition of the vehicle is satisfied in the driving situation in which the large amount of fuel evaporation gas is discharged, a cylinder counter is accumulated by counting the number of cylinder combustion.

Then, transport delay that is required to transport the fuel evaporation gas from the PCSV 5 to a combustion chamber may be calculated by functions of engine RPM and the intake air amount, which is defined as follows.

Transport delay=f (engine RPM and intake air amount)

Subsequently, a delay correction filter may be calculated by functions of engine RPM and the cylinder counter, which is defined as follows.

Delay correction filter=f (engine RPM and accumulated cylinder counter)

Here, the delay correction filter may be higher than 0 and is equal to or less than 1 (0<delay correction filter≤1).

In addition, the transport delay is corrected by multiplying the transport delay by the delay correction filter, which is defined as follows.

New transport delay=transport delay*delay correction filter

Then, the purge duty may be arithmetically operated by multiplying a value obtained by functions of the target purge flow, the corrected new transport delay, and the intake air pressure of the engine by a correction factor determined by the atmospheric pressure and intake air temperature, which is defined as follows.

Purge duty=f (target purge flow, new transport delay, and intake air pressure of engine)*correction factor (atmospheric pressure, intake air temperature)

That is, when the dynamic purge condition is satisfied according to the present disclosure, the delay correction filter is determined depending on the engine RPM and the cylinder counter to correct the transport delay, and the corrected new transport delay is applied to the purge duty. Therefore, operation period of the PCSV 5 is optimized for each driving range of the vehicle (the engine RPM and the cylinder counter), so that the air-fuel ratio may be controlled optimally.

In addition, in the present disclosure, when the accumulative cylinder counter is higher than a predetermined value, the purge control method may further include resetting the cylinder counter to 0 and setting the delay correction filter to one after the cylinder counter is reset to zero.

That is, when the dynamic purge condition is satisfied, the cylinder counter is simultaneously accumulated. Thus, by calculating the delay correction filter as a value between zero and one until the accumulative cylinder counter is higher than a specific value and by setting the delay correction filter to one when the accumulative cylinder counter is higher than the specific value, the air-fuel ratio is controlled not to be lean due to decrease of the purge flow for a predetermined period, so that flow of the air-fuel ratio may be prevented from being excessive.

Referring to FIG. 2, flow of a purge control process of the present disclosure will be described, the atmospheric pressure, the engine intake air pressure, the intake air temperature, the intake air amount, and the accelerator pressing amount may be input to the CLR, then the target purge flow, the purge concentration, the cylinder counter, and a slope of the accelerator pressing amount, etc. may be determined on the basis of the input signals.

During driving, it is determined whether or not the purge concentration is higher than a (S10). When a determination result is higher than a, it is determined whether or not the accelerator pressing amount is higher than b and the intake air amount is higher than c (S20).

In a state in which a determination result (S20) satisfies above-mentioned conditions, it is determined whether or not the accelerator pressing amount is less than d and the slope of the accelerator pressing amount is less than e when a driver momentarily takes a foot off the accelerator (S30). When the above conditions are satisfied, the dynamic purge condition is determined to be satisfied and the number of times to be combust is simultaneously counted to accumulate the cylinder counter (S40).

Subsequently, the transport delay is calculated by the functions of the engine RPM and the intake air amount (S50), and the delay correction filter is calculated and determined by the functions the engine RPM and the cylinder counter (S60).

The new transport delay is obtained by multiplying the transport delay by the delay correction filter (S70).

The purge duty is arithmetically operated by multiplying the value determined by the functions of the target purge flow, the corrected new transport delay, and the engine intake air pressure by the correction factor determined by the atmospheric pressure and the intake air temperature (S80).

The operation of the PCSV 5 is controlled by the operated purge duty to purge the fuel evaporation gas (S90).

Then, it is determined whether or not the cylinder counter is within a range between zero and f (S100), and when the determination result is within the range, the process returns to S40 again and is repeatedly performed until the cylinder counter is higher than f.

However, when the cylinder counter is less than zero or is higher than f, the cylinder counter is reset to 0 (S110).

Then, the transport delay is arithmetically operated by the functions of the engine RPM and the intake air amount (S120), and the delay correction filter is set to one (S130).

The purge duty is arithmetically operated by multiplying the value obtained by the functions of the target purge flow, the transport delay, and the engine intake air pressure by the correction factor determined by the atmospheric pressure and the intake air temperature (S140).

The operated purge duty controls the operation of the PCSV 5 to purge the fuel evaporation gas (S100).

That is, since the delay correction filter is set to one, the purge duty may be calculated by applying the transport delay before correction, and thus the operation of the PCSV 5 is controlled by the purge duty calculated above.

In addition, when at least any one of determination results in S10, S20, and S30, is not satisfied, the process returns to S110 to reset the cylinder counter to zero and then proceeds to next steps.

Likewise, according to the present disclosure, in the case of the driving condition in which the large amount of fuel evaporation gas is discharged, since the fuel ratio due to the purge flow decreases in the total fuel by the decrease control of the purge duty, the air-fuel ratio is prevented from being rich and the combustion stability is improved, so that it is possible to prevent start-off and shock occurrence, and to attenuate the introduction of fuel odor into a vehicle due to an increase in the purge flow.

Although a preferred embodiment of the present disclosure has been described for illustrative purposes, those skilled in the art will appreciate that various modifications, additions and substitutions are possible, without departing from the scope and spirit of the invention as disclosed in the accompanying claims.

What is claimed is:

1. A method of controlling purge of fuel evaporation gas, the method comprising:

determining, by a controller, that a vehicle decelerates above a preset value in a driving situation in which an amount of the fuel evaporation gas is discharged above a preset amount;

decreasing, by the controller, a purge duty for operating a purge control solenoid valve in response to the controller determining that the vehicle decelerates above the preset value; and decreasing, by the controller, a purge flow of the fuel evaporation gas by controlling operation of the purge control solenoid valve by the purge duty, wherein decreasing the purge duty comprises:

accumulating a cylinder counter by counting a count of cylinder combustion;

calculating a transport delay required to transport the fuel evaporation gas from the purge control solenoid valve to a combustion chamber by functions of engine revolutions per minute (RPM) and an intake air amount;

determining a delay correction filter by functions of the engine RPM and the cylinder counter;

correcting the transport delay by multiplying the transport delay by the delay correction filter; and arithmetically operating the purge duty by multiplying a value determined by functions of a target purge flow, the corrected transport delay, and intake air pressure of an engine by a correction factor determined by atmospheric pressure and intake air temperature.

2. The method of claim 1, wherein it is determined that the vehicle decelerates above the preset value in the driving situation in which the amount of the fuel evaporation gas is discharged above the preset amount when purge concentration is higher than a predetermined value, an accelerator pressing amount is higher than a first reference value, and the intake air amount is higher than a predetermined amount.

3. The method of claim 1, wherein it is determined that the vehicle decelerates above the preset value when an accelerator pressing amount is less than a second reference value and a slope of the amount of pressing the accelerator is less than a reference value.

4. The method of claim 1, wherein the delay correction filter is higher than zero and is equal to or less than one ($0<\text{delay correction filter}\leq 1$).

5. The method of claim 4, further comprising resetting the cylinder counter to zero when the accumulated cylinder counter is higher than a predetermined value.

6. The method of claim 5, further comprising setting the delay correction filter to one after the cylinder counter is reset to zero.

7. A method of controlling purge of fuel evaporation gas, the method comprising:

determining, by a controller, that a vehicle is in a driving situation in which an amount of the fuel evaporation gas is discharged above a preset amount, wherein it is determined that the vehicle is in the driving situation in which the amount of the fuel evaporation gas is discharged above the preset amount when purge concentration is higher than a predetermined value, an accelerator pressing amount is higher than a first reference value, and an intake air amount is higher than a predetermined amount;

decreasing, by the controller, a purge duty for operating a purge control solenoid valve in response to the controller determining that the vehicle decelerates above a preset value;

decreasing, by the controller, a purge flow of the fuel evaporation gas by controlling operation of the purge control solenoid valve by the purge duty;

accumulating a cylinder counter by counting a count of cylinder combustion;

calculating a transport delay required to transport the fuel evaporation gas from the purge control solenoid valve to a combustion chamber by functions of engine revolutions per minute (RPM) and the intake air amount;

determining a delay correction filter by functions of the engine RPM and the cylinder counter;

correcting the transport delay by multiplying the transport delay by the delay correction filter; and arithmetically operating the purge duty by multiplying a value determined by functions of a target purge flow, the corrected transport delay, and intake air pressure of an engine by a correction factor determined by atmospheric pressure and intake air temperature.

8. The method of claim 7, wherein the delay correction filter is higher than zero and is equal to or less than one (0<delay correction filter≤1).

9. The method of claim 8, further comprising resetting the cylinder counter to zero when the accumulated cylinder counter is higher than a predetermined limit and setting the delay correction filter to one after the cylinder counter is reset to zero.

10. A vehicle comprising:

a fuel tank;

a canister coupled to the fuel tank;

a purge control solenoid valve coupled to the canister; and a controller configured to:

determine whether or not the vehicle decelerates above a preset value in a driving situation in which an amount of fuel evaporation gas is discharged above a preset amount;

decrease a purge duty for operating the purge control solenoid valve when the controller determines that the vehicle decelerates above the preset value; and decrease a purge flow of the fuel evaporation gas by controlling operation of the purge control solenoid valve by the purge duty, wherein the controller is configuredto decrease the purge duty by:

accumulating a cylinder counter by counting a count of cylinder combustion when the vehicle decelerates above the preset value in the driving situation in which the amount of the fuel evaporation gas is discharged above the preset amount;

calculating a transport delay required to transport the fuel evaporation gas fro m the purge control solenoid valve to a combustion chamber by functions of engine revolutions per minute (RPM) and an intake air amount;

determining a delay correction filter by functions of the engine RPM and the cylinder counter;

correcting the transport delay by multiplying the transport delay by the delay correction filter; and arithmetically operating the purge duty by multiplying a value determined by functions of a target purge flow, the corrected transport delay, and intake air pressure of an engine by a correction factor determined by atmospheric pressure and intake air temperature.

11. The vehicle of claim 10, wherein the controller is configured to determine that the vehicle decelerates above the preset value in the driving situation in which the amount of the fuel evaporation gas is discharged above the preset amount when purge concentration is higher than a predetermined value, an accelerator pressing amount is higher than a first reference value, and the intake air amount is higher than a predetermined amount.

12. The vehicle of claim 10, wherein the controller is configured to determine that the vehicle decelerates above the preset value when an accelerator pressing amount is less than a second reference value and a slope of the amount of pressing an accelerator is less than a reference value.

13. The vehicle of claim 10, wherein the delay correction filter is higher than zero and is equal to or less than one (0<delay correction filter≤1).

14. The vehicle of claim 13, wherein the controller is further configured to reset the cylinder counter to zero when the accumulated cylinder counter is higher than a predetermined limit.

15. The vehicle of claim 14, wherein the controller is further configured to set the delay correction filter to one after the cylinder counter is reset to zero.

* * * * *